US005616076A

United States Patent [19]

Higgins

[11] Patent Number: 5,616,076

[45] Date of Patent: Apr. 1, 1997

[54] NON-CLOGGING GUARD FOR HOUSEHOLD DRYER HOODED VENTS

[76] Inventor: Don E. Higgins, 1401 Daline St., Springdale, Ariz. 72762

[21] Appl. No.: 398,547

[22] Filed: Apr. 13, 1995

[51] Int. Cl.[6] ..... F23L 17/02

[52] U.S. Cl. ..... 454/367; 454/359

[58] Field of Search ..... 454/260, 353, 454/359, 367; 34/235; 150/154

[56] References Cited

U.S. PATENT DOCUMENTS

| | | | |
|---|---|---|---|
| 2,551,782 | 5/1951 | Zaske | 454/367 |
| 3,777,643 | 12/1973 | Luckey | 454/260 |
| 4,126,973 | 11/1978 | Luckey | 454/260 X |
| 4,189,878 | 2/1980 | Fitzgerald | 454/260 X |
| 4,292,927 | 10/1981 | Sasmann | 454/253 X |
| 4,480,534 | 11/1984 | Sloan | 454/182 |
| 5,046,408 | 9/1991 | Eugenio | 454/359 |

FOREIGN PATENT DOCUMENTS

| | | | |
|---|---|---|---|
| 1732258 | 3/1980 | Canada | 454/260 |

*Primary Examiner*—Harold Joyce

[57] ABSTRACT

A vent guard that keeps birds out. This vent guard is designed with round, smooth bars which do not hold lint from dryers. The bars dropped down lower than the frame design allows wind to keep it clean.

Present materials used to fashion the vent guard are polypropolene and polyethylene, with ultraviolet ray blockers.

2 Claims, 5 Drawing Sheets

NON-CLOGGING GUARD FOR HOUSEHOLD DRYER HOODED VENTS

BACKGROUND—FIELD OF INVENTION

This invention relates to plastic guards. Specifically, guards that prevent birds from entering into dryer and bath hooded vent exhausts, usually mounted on the outside walls of dwellings.

BACKGROUND—DESCRIPTION OF PRIOR ART

Building supply companies commonly supply builders and homeowners with hooded vents that have some type of flap, which opens under air pressure from dryer and bath exhaust fans. These flaps often are lifted open by birds looking for nesting areas. This vent then becomes clogged with nesting materials causing disfunction.

Objects and Advantages Several objects and advantages of the present invention are:

(a) To provide a closure which will effectively prevent birds from entering.

(b) To provide a closure which is designed to fit most vent heads in use.

(c) To provide a closure which is tough, durable, thicker and stronger than the vent head it is mounted on.

(d) To provide a closure which is safe to birds. Keeping birds out of vents when the dryer is turned on often causes the death of hatchlings, due to heat from dryers.

(e) The rounded bar design is non-clogging from lint blowing through from dryers.

(f) The rounded bar design also utilizes breezes to keep it-self clean.

BRIEF DESCRIPTION OF DRAWINGS

In the drawings the same vent guard is shown in different views.

DESCRIPTION OF THE PREFERRED EMBODIMENTS

Figure 1:
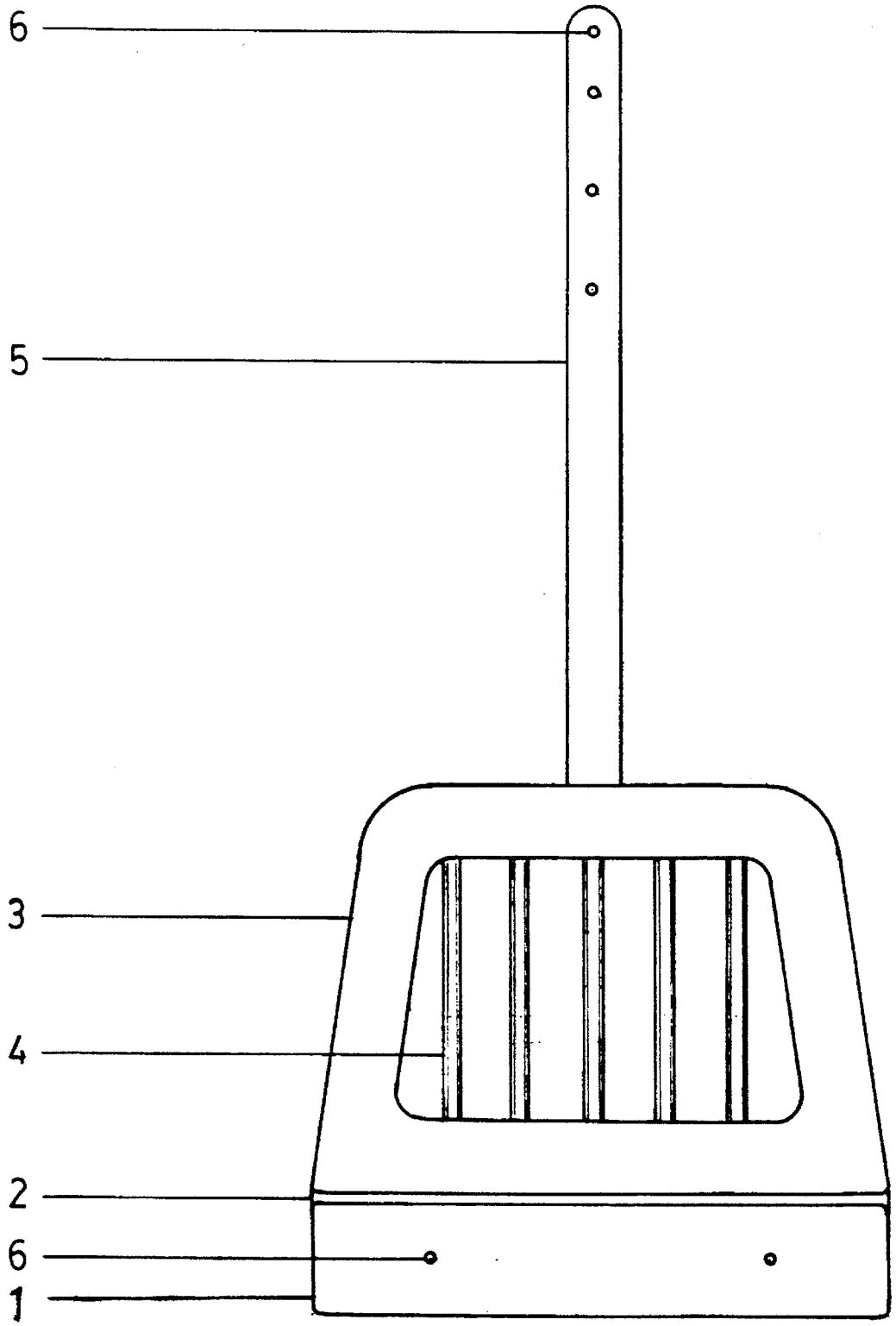
FIG. 1 shows a full view of the vent guard as if it was laying flat.

Beginning with FIG. 1, at the bottom of the vent guard is a hinged base 1. A hinge 2, known as a living hinge, is part of the molded plastic and is not separately attached. The hinge section is a thinner section which measures 2.39 mm×0.787 mm. Below the hinge area lies the base I of the vent guard. The base measures 152.4 mm wide, 31.76 mm high, and 4.78 mm thick with two holes 6 measuring 3.18 mm used when attaching the base to a structure.

Above the base and hinge section begins the body section 3 which includes rounded bars 4. The base of the body section 3 also measures 152.4 mm wide and tapers to the top at a 7 degree angle towards center for a distance of 114.29 mm high. The top left and right corners of the body have an outside radius of 19.05 mm and an inside radius of 6.35 mm. This gives a flat width at the top of the body between the radius corners of 106.25 mm. The body section has an entire thickness of 4.78 mm. The round bars of the body section are 4.78 mm in diameter and are spaced 17.48 mm apart. The body frame is 19.05 mm in width.

A mounting strap 5, shown in FIG. 1 is centered at the top of the vent guard body. The strap 5 is 181.25 mm in length, and 1.57 mm thick. The strap 5 has three mounting holes 6. Each hole 6 is 3.18 mm diameter. The lowest hole is 101.6 mm from the top of the body. The middle hole is 127.0 mm from the top of the body. The top hole is 152.4 mm from the top of the body. The extreme top of the strap has a full radius. The strap is capable of a range movement of 90 degrees in either direction.

Figure 2:
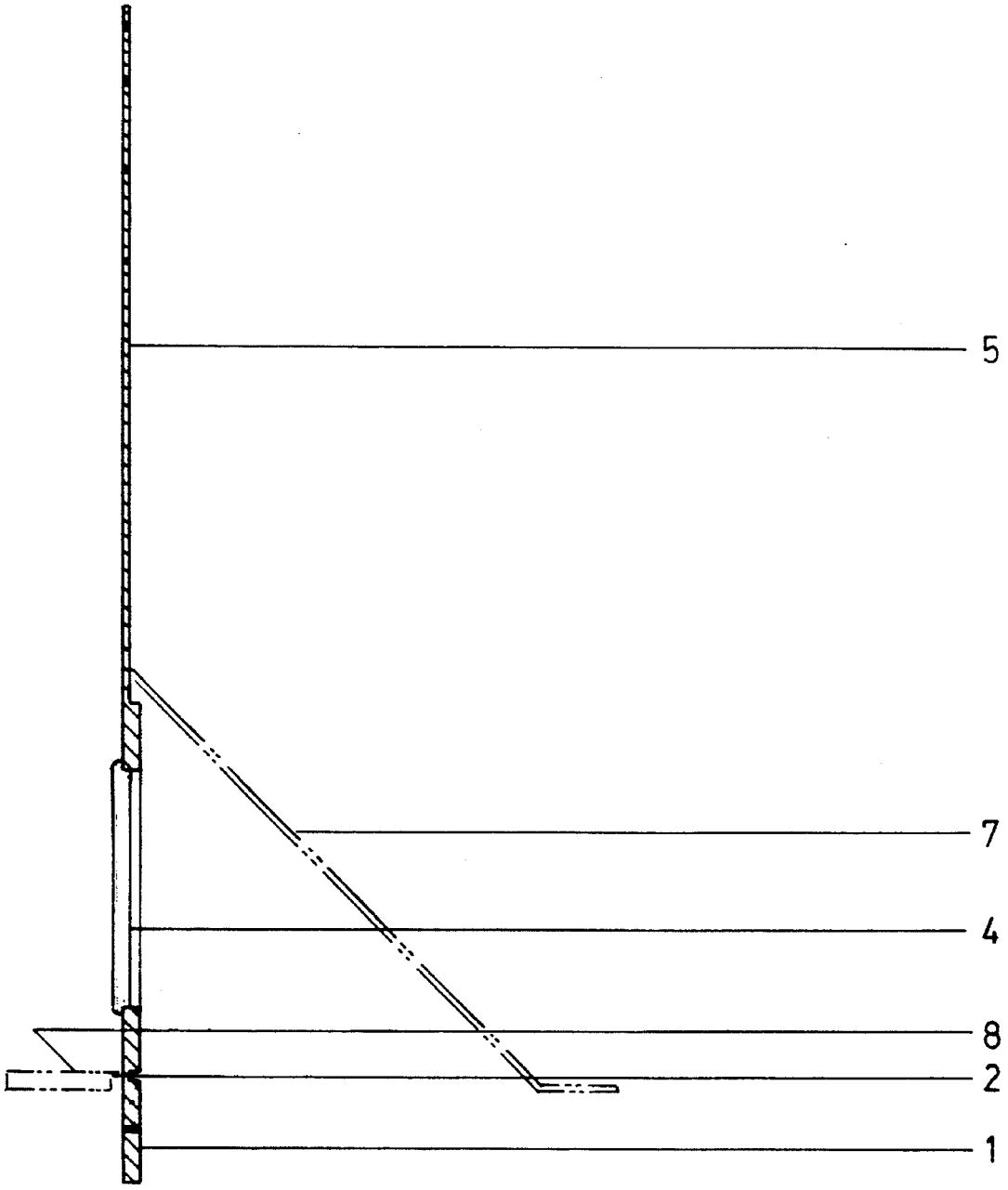
FIG. 2 shows a side view of the vent guard, as if turned side-ways.

FIG. 2 shows a side view of the vent guard. This view shows in phantom the mounting base moved to a 90 degree angle and the mounting strap moved to one of its variable positions.

Figure 3:
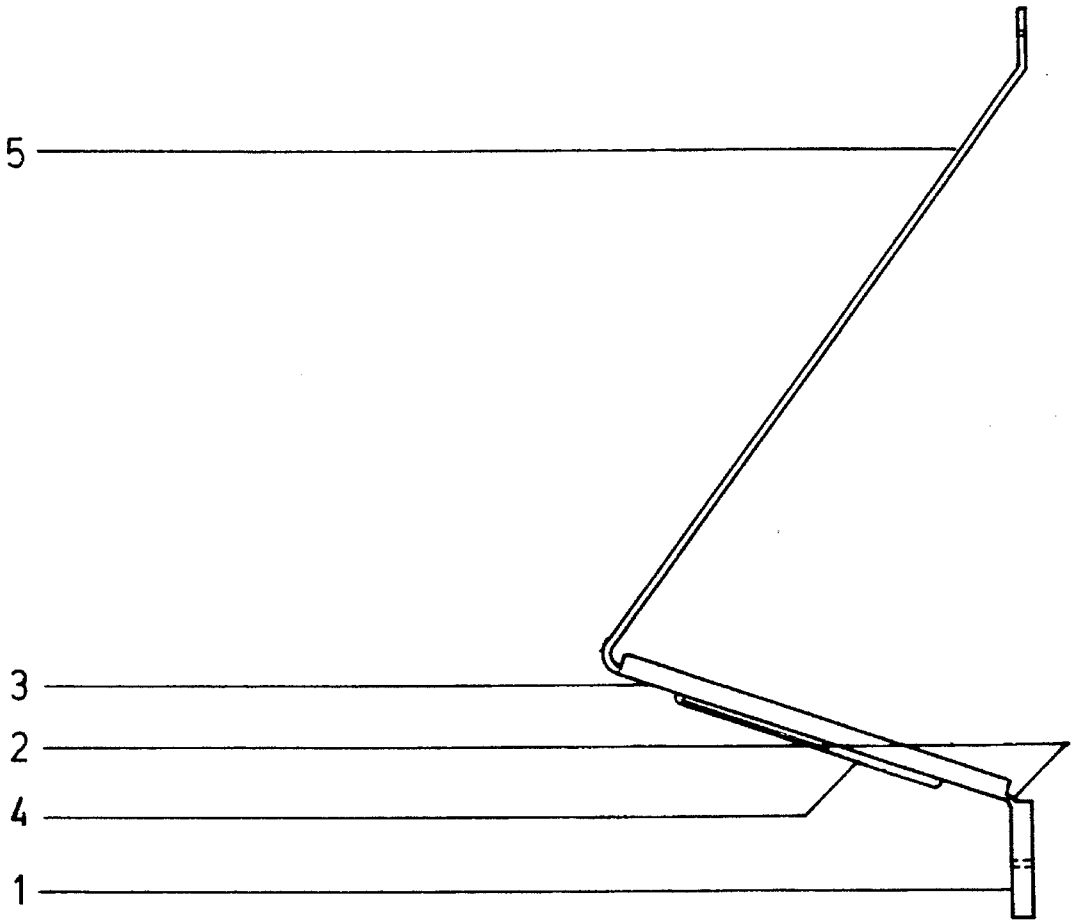
FIG. 3 shows a side view of the vent guard, in a position that it would be in, when mounted on a vent. Vent would be protruding from the outside wall of a structure.

FIG. 3 shows the position that the entire vent guard would be in looking from a side view, if it was set up attached to a vent. Shown in this view are the lowered bars 4, lower than the body frame 3. The positioning of the bars 4 enables wind movement to keep them clean.

Figure 4:
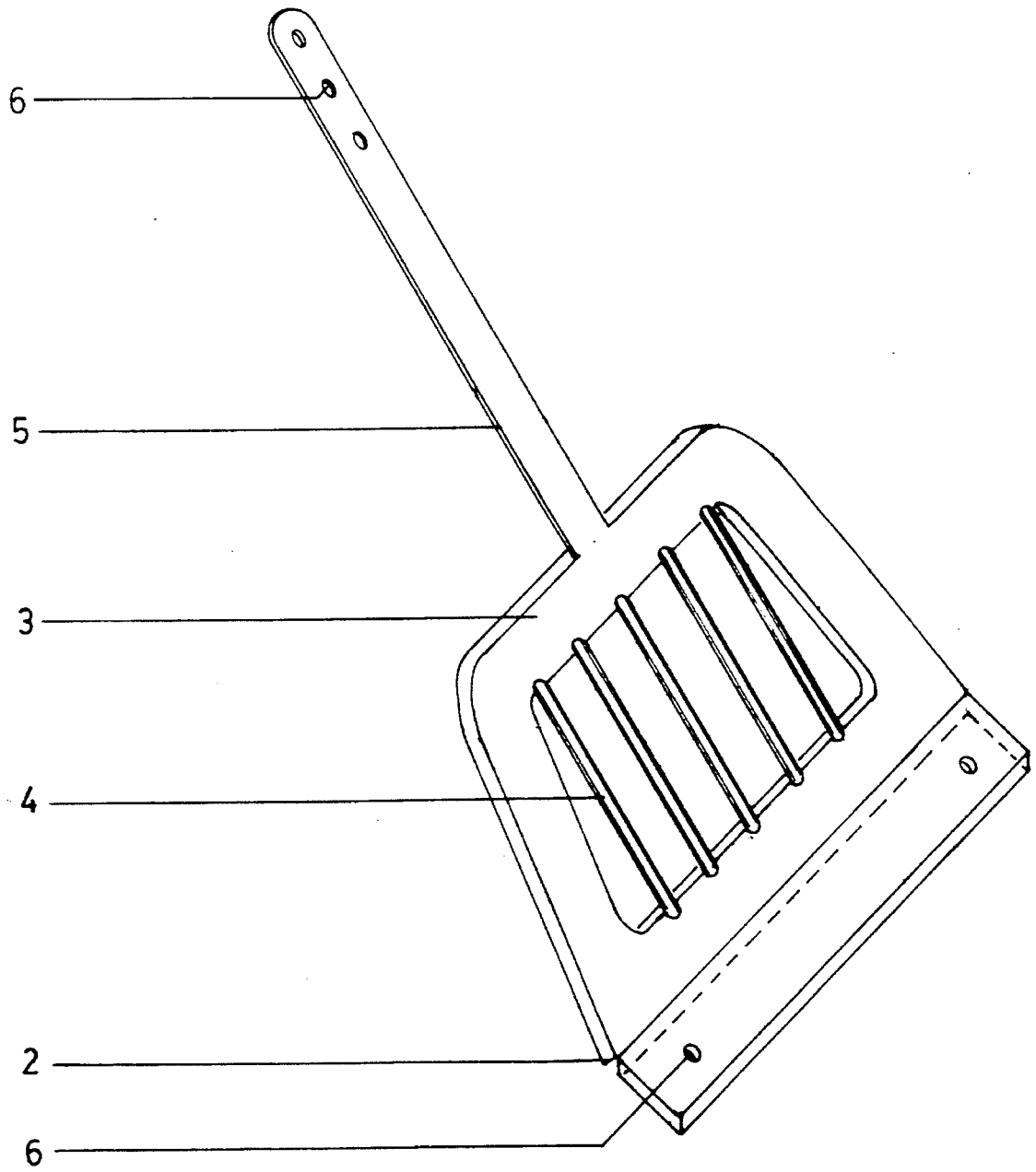
FIG. 4 shows a prospective view of the vent guard and hinged section.

FIG. 4 shows an angle view of the base and body and part of the strap.

Figure 5:
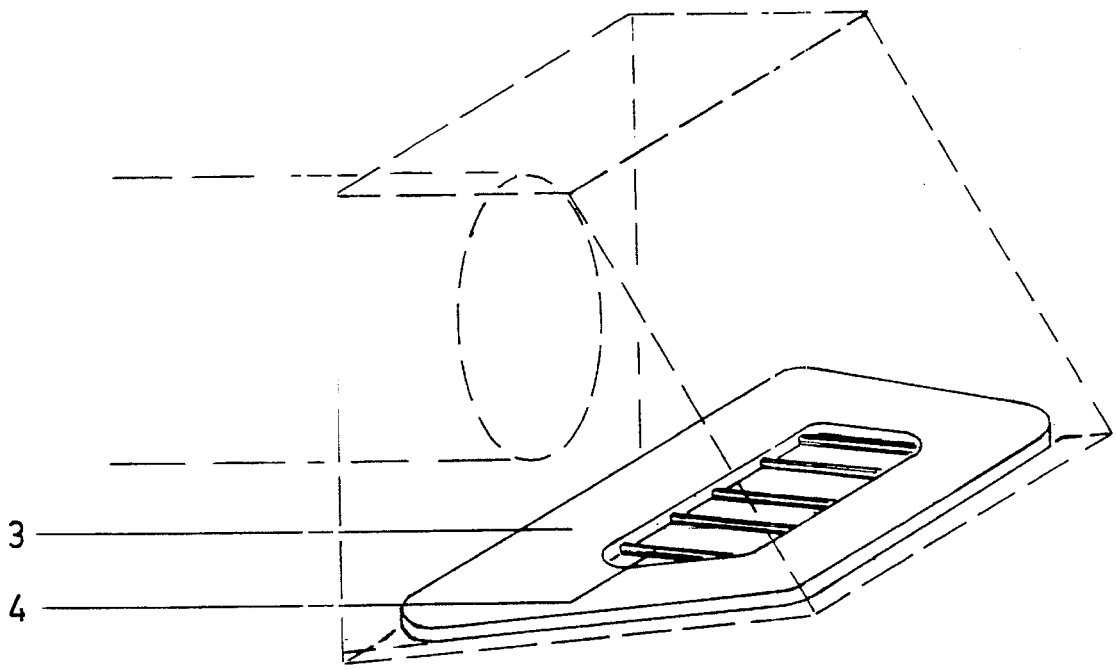
FIG. 5 shows vent guard installed inside a vent. In this embodiment the strap and mounting base are removed. The rounded bar design and frame become one unit with the vent hood.

FIG. 5 shows the same vent guard without the base and without the mounting strap. In this view the guard is part of the vent hood. This guard would be completely attached to the mouth of a vent as a solid unit.

Present materials used to fashion the vent guard are polypropylene and polyethylene, with ultraviolet ray blockers. This material suits the guard as it must withstand heat, cold and sun as well as water and ice.

Operation of Invention

The vent guard operates by first installing the base against a structure and directly under its protruding vent hood. The body of the vent guard is then swung upwards till the entire mouth of a vent hood is flush with it. The mounting strap is then secured above the vent hood onto the building wall structure providing tension to the body of the guard. Installed in such a manner the vent guard is secured.

The second embodiment vent guard is built together as one solid unit. This embodiment has no need of the strap or base.

SUMMARY, RAMIFICATIONS, AND SCOPE

This vent guard prevents birds from entering vent hoods that are used for dryer and bath power vents. Specifically, vent hoods which are through the walls and mounted on the outside walls of structures. This vent guard is of benefit because it helps keep vents clean and fully operational. Preventing hatchlings from entering vents is beneficial, by preventing death due to the heat from dryers. The materials used in the manufacture of the vent guard, is generally superior in both quality and thickness than the vents they protect. The lowered bar design is non-clogging.

I claim:

1. A one piece, plastic vent guard for preventing the entrance of birds into a vent hood having a downwardly directed substantially rectangular outlet for the dishcharge of air from a clothes dryer, the vent hood being attached to the outer wall of a building, said vent comprising:

(a) a body section in the shape of the outlet of the vent hood having a central opening therein, said central opening having a plurality of parallel round bars in closely spaced relationship to prevent birds from entering therethrough;

(b) a substantially rectangular shaped base section secured to the lower edge of the body section via a living hinge, said base section having apertures therein for securing by fasteners to the wall of a building adjacent the vent hood outlet; and (c) an elongated strap portion secured to the upper edge of the body section via a living hinge, said strap portion having apertures at the distal end thereof for securing by fasteners to the wall of a building above the vent hood; wherein when the base section and strap portion is secured to the wall, the central opening of the body section will be in juxtaposition with the vent hood outlet.

2. The vent guard in accordance with claim 1, wherein the plurality of round bars are position below the plane of the central opening in the body section, whereby wind will keep the bars clear of lint from the dryer.

* * * * *